US006227198B1

(12) United States Patent
Wiegand et al.

(10) Patent No.: US 6,227,198 B1
(45) Date of Patent: May 8, 2001

(54) UNDERWATER BREATHING APPARATUS

(75) Inventors: Stephan Wiegand, Lübeck; Jürgen Tillmann, Neustadt, both of (DE)

(73) Assignee: Dräger Sicherheitstechnik GmbH, Lübeck (DE)

( * ) Notice: Subject to any disclaimer, the term of this patent is extended or adjusted under 35 U.S.C. 154(b) by 0 days.

(21) Appl. No.: 09/288,634

(22) Filed: Apr. 9, 1999

(30) Foreign Application Priority Data

Apr. 11, 1998 (DE) ..... 198 16 300

(51) Int. Cl.[7] ..... B63C 11/02

(52) U.S. Cl. ..... 128/201.27; 128/202.19

(58) Field of Search ..... 128/205.28, 209.29, 128/201.26–201.29, 201.22, 202.19; 405/186, 187; 2/2.15, 462; 441/106, 108, 113, 114, 132; 55/486, 487

(56) References Cited

U.S. PATENT DOCUMENTS

| | | | | |
|---|---|---|---|---|
| 2,456,130 | * | 12/1948 | Lambertsen | 128/142 |
| 2,483,116 | | 9/1949 | Yarbrough . | |
| 3,080,586 | | 3/1963 | Steinke . | |
| 3,866,253 | * | 2/1975 | Sinks et al. | 9/313 |
| 3,877,425 | * | 4/1975 | O'Neill | 128/142 |
| 3,934,581 | | 1/1976 | O'Neill . | |
| 4,000,534 | * | 1/1977 | Cerniway et al. | 9/342 |
| 4,752,263 | * | 6/1988 | Pritchard et al. | 441/88 |
| 4,964,404 | * | 10/1990 | Stone | 128/204.22 |
| 5,048,517 | * | 9/1991 | Pasternack | 128/205.28 |
| 5,315,988 | * | 5/1994 | Clarke et al. | 128/204.23 |
| 5,368,020 | * | 11/1994 | Beux | 128/204.29 |
| 5,451,121 | | 9/1995 | Seligman . | |
| 5,804,015 | * | 9/1998 | McCarter et al. | 156/209 |
| 5,887,585 | * | 3/1999 | Dusenbery | 128/202.14 |
| 6,030,147 | * | 2/2000 | Bowden | 405/186 |

FOREIGN PATENT DOCUMENTS

| | | |
|---|---|---|
| 0782953 | 7/1997 | (EP) . |
| 2708560 | 2/1995 | (FR) . |
| 7-277276 | 10/1995 | (JP) . |

* cited by examiner

*Primary Examiner*—Dennis Ruhl
*Assistant Examiner*—Teena Mitchell
(74) *Attorney, Agent, or Firm*—Walter Ottesen

(57) ABSTRACT

An underwater breathing apparatus is so improved that it is simple to manufacture and that it provides a decoupling of the breathing gas conducting components and attachment elements. A support vest (2) is provided which includes an inner enclosure (3) and a textile outer enclosure. The inner enclosure (3) extends from the shoulders to the hips of the person carrying the apparatus. The inner enclosure (3) is made of two panels (31, 32) which lie one atop the other. On the periphery, the panels (31, 32) are provided with a first weld seam (33) which connects the panels at the periphery. Further weld seams (34, 36, 37), which connect the panels, are provided within the inner enclosure (3). The weld seams (34, 36, 37) subdivide the inner enclosure (3) into at least an inhalation bag (38), an exhalation bag (39) and a buoyancy bag (40). The outer enclosure has a pocket for a mixed-gas vessel, a holder for a carbon dioxide absorber and belts for securing the outer enclosure to the back of the person carrying the apparatus.

10 Claims, 5 Drawing Sheets

UNDERWATER BREATHING APPARATUS

FIELD OF THE INVENTION

The invention relates to an underwater breathing apparatus wherein the breathing gas flow is controlled by directional valves and the exhalation gas is again inhaled after removal of the carbon dioxide.

BACKGROUND OF THE INVENTION

An underwater breathing apparatus of the above kind is disclosed in U.S. Pat. No. 2,483,116. The known breathing apparatus includes an inhalation bag, an exhalation bag and a buoyancy bag which are all attached to the torso of a diver by individual belts. An inhalation tube leads from the inhalation bag and an exhalation tube leads from the exhalation bag to a diver mask which is provided with directional valves for controlling the breathing gas flow. The two breathing bags are connected to each other via a carbon dioxide absorber which serves to remove the carbon dioxide from the exhaled gas. An oxygen bottle is disposed in a pocket below the breathing bags and is connected to the inhalation bag via a metering valve. A buoyancy bag is arranged below the two breathing bags and can be filled with oxygen as required in order to adjust the upward force in the water to a desired value.

In the known breathing apparatus, by the placement of the oxygen bottle in a pocket (which is configured as an extension of the breathing bags) and the attachment of the buoyancy bag below the breathing bags and the oxygen bottle, the expansion of the buoyancy bag as well as the expansion of the breathing bags are all hindered by the attachment belts. Accordingly, the attachment belts, which are pulled tightly before a diving operation, must again be loosened after diving into the water so that the bags can expand unhindered. This affects the usability of the underwater apparatus. Furthermore, the known breathing apparatus is expensive to manufacture because the breathing bags and the buoyancy bag must be joined as separate components.

SUMMARY OF THE INVENTION

It is an object of the invention to improve an underwater breathing apparatus of the kind referred to above so that it is easy to manufacture and so that a decoupling of the breathing gas conducting components and the attachment elements is achieved.

The underwater breathing apparatus of the invention is worn on the back of a diver. The apparatus includes: a support vest including an inner enclosure and a textile outer enclosure; the inner enclosure extending from the shoulders to the hips of the diver; the inner enclosure being formed from two panels made of elastomeric material and lying one atop the other and having a plurality of individual weld seams for subdividing the inner enclosure into an inhalation bag, an exhalation bag and a buoyancy bag; a mouthpiece; a first breathing tube connecting the inhalation bag to the mouthpiece; a second breathing tube connecting the exhalation bag to the mouthpiece; a carbon dioxide absorber arranged between the inhalation bag and the exhalation bag; a mixed-gas vessel connected at least to the inhalation bag; and, the textile outer enclosure including: a pocket for the mixed-gas vessel; a holder for the carbon dioxide absorber and belts for attaching the outer enclosure to the back of the diver.

The support vest has an inner enclosure, which includes, as a unit, the inhalation bag, the exhalation bag and the buoyancy bag and has the outer enclosure (made of a textile fabric) which contains all attachment belts and holders for the pressurized bottle and the carbon dioxide absorber. The advantage of the invention is seen in that this support vest conducts the force flow directly from the outer enclosure via the attachment belts to the back of the person carrying the apparatus.

The inner enclosure comprises two panels of an elastomer material one atop the other which are connected by individual weld seams and are subdivided by the weld seams into the inhalation bag, the exhalation bag and the buoyancy bag. The subdivision into the inhalation bag, the exhalation bag and the buoyancy bag is provided because of the geometry and the course of the weld seams.

In an advantageous manner, the inner enclosure is configured as an elastomer inner coating of the textile outer enclosure. The carrier vest can be especially easily manufactured as a so-called single-shell support vest in that two textile material panels coated with elastomer on one side are placed one against the other and are welded to each other. Nylon fabric having a polyurethane coating is especially suitable as a material for the support vest.

An advantageous configuration of the invention comprises a two-shell embodiment of the support vest. Here, the outer enclosure and the inner enclosure are configured as separate components with the inner enclosure being placed in the outer enclosure. This embodiment affords the advantage that the inner enclosure can unfold especially well under water because of the point mechanical coupling between the inner and outer enclosures.

An especially good use of space of the inner enclosure is achieved by a first weld seam running on the periphery of the elastomeric panels. The weld seams lying within the inner enclosure are purposefully configured as a second weld seam running along a connecting line between the inhalation bag and the exhalation bag and as a third weld seam and a fourth weld seam running from the second weld seam to the first weld seam.

An especially large volume for the inhalation bag and the exhalation bag results when the third weld seam and the fourth weld seam are curved to parabola-shaped legs running toward the first weld seam. The second weld seam is connected to the apex point of the two parabolic legs. The curvature of the third weld seam and the fourth weld seam in the region of the apex point can also be configured to have the shape of circular segments or have the shape of a polygon.

A fifth welding seam is advantageously provided in the buoyancy bag and is closed upon itself. With this fifth weld seam, a volume is separated from the buoyancy bag. The usable inner volume of the buoyancy bag can be changed by the geometry of the fifth weld seam.

In an advantageous manner, the inhalation bag and the exhalation bag as well as the parts of the outer enclosure disposed thereabove are configured as projections directed outwardly. The length of the projections is so dimensioned that they can be folded back in the direction toward the carbon dioxide absorber disposed in the outer enclosure. Insert connectors are located on the projections and can be connected to the carbon dioxide absorber so that a gas connection between the inhalation bag and the exhalation bag is established.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
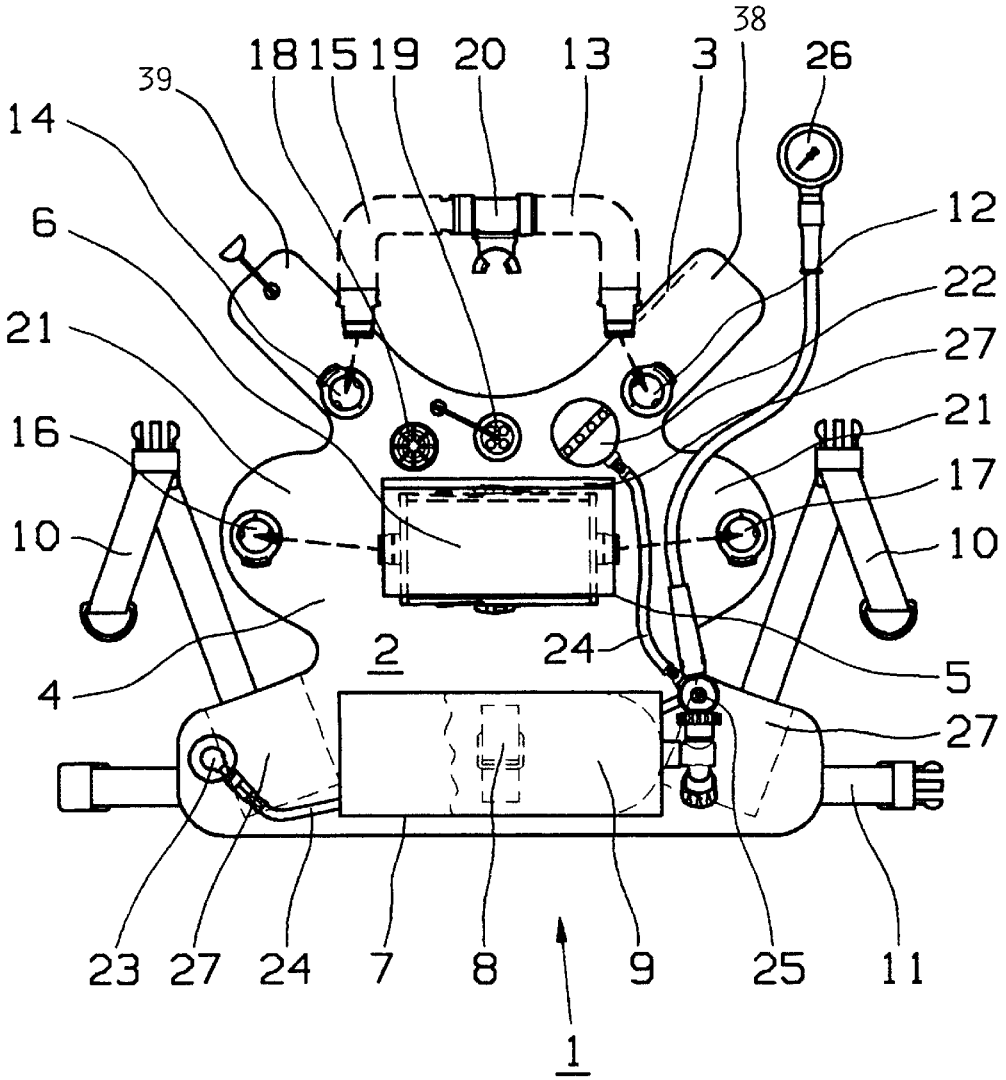
FIG. 1 is a plan view of a breathing apparatus with a view toward the back of a person carrying the apparatus.

FIG. 1 shows a plan view of an underwater breathing apparatus 1 with a view toward the back of a person (not shown) carrying the apparatus. The underwater breathing apparatus, which is carried on the back, comprises a two-shell support vest 2 having an inner enclosure 3 made of nylon-reinforced polyurethane and a textile outer enclosure 4 which is provided with a holder 5 for a carbon dioxide absorber 6 and a pocket 7 having a tensioning belt 8 for a mixed-gas vessel 9.

Further, two shoulder straps 10 and a stomach belt 11 are disposed on the outer enclosure 4. The inner enclosure 3 is surrounded by the outer enclosure 4. In FIG. 1, only a first insert connector 12 for an inhalation tube 13, a second insert connector 14 for an exhalation tube 15, a third insert connector 16 and a fourth insert connector 17 for the carbon dioxide absorber 6 as well as a pressure valve 18 and a hand-actuable overpressure valve 19 can be seen. Between the breathing tubes (13, 15), a mouthpiece 20 is disposed which contains directional valves (not shown in FIG. 1) for controlling the breathing gas flow. The carbon dioxide absorber 6 is connected to the insert connectors (16, 17). For this purpose, and in the region of the insert connectors (16, 17), an inhalation bag 38 and an exhalation bag 39 are provided with projections 21 extending outwardly. These projections 21 can be folded over in a direction toward the carbon dioxide absorber 6.

The insert connectors (12, 14, 16, 17) and the overpressure valves (18, 19) are pass-through buttoned via corresponding breakthroughs disposed in the outer enclosure 4. A demand valve 22 (self-acting valve which opens when the diver inhales) having an integrated constant metering and an inflation valve 23 are also connected to the inner enclosure 3. The inflation valve 23 and the demand valve 22 are connected via pressure tubes 24 to a pressure reducer 25 disposed on the mixed-gas vessel 9. A high-pressure manometer 26 is located at the high pressure output of the pressure reducer 25 in order to monitor the fill pressure of the mixed-gas vessel 9. The mixed-gas vessel 9 has a volume of 2.5 to 3 liters and is filled with a nitrox mixture. The demand valve 22 and the constant metering, which runs in the manner of a bypass with respect to the demand valve, are so dimensioned that a permanent oxygen consumption of the diver of approximately 2.5 liter per minute is covered without the volume content of oxygen dropping below 16 percent by volume.

Pockets 27 are provided in the outer enclosure 4 to stabilize the position of the diver in the water. Buoyancy weights (not shown) can be inserted into the pockets 27.

Figure 2:
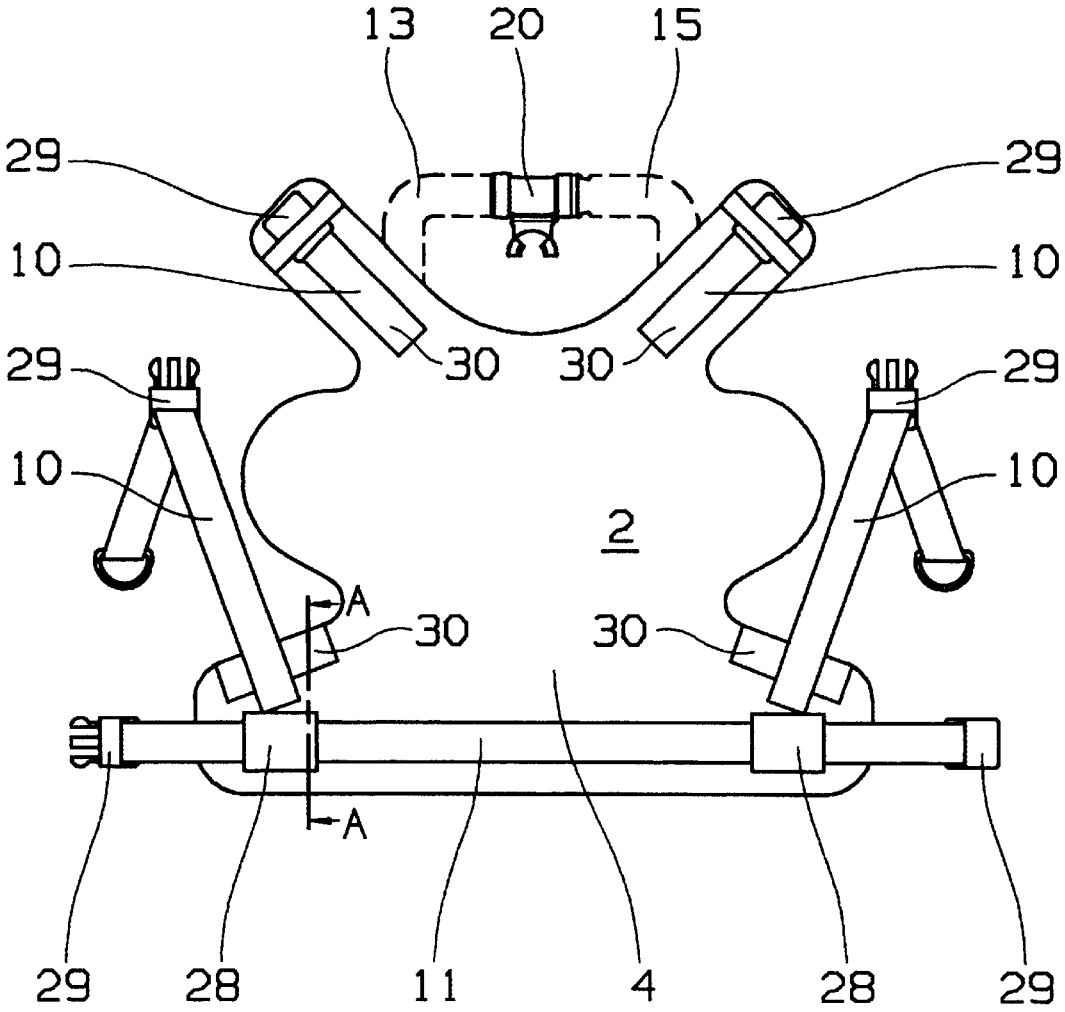
FIG. 2 is a schematic of the breathing apparatus of FIG. 1 with a view toward the side lying against the back of the wearer.
Figure 4:
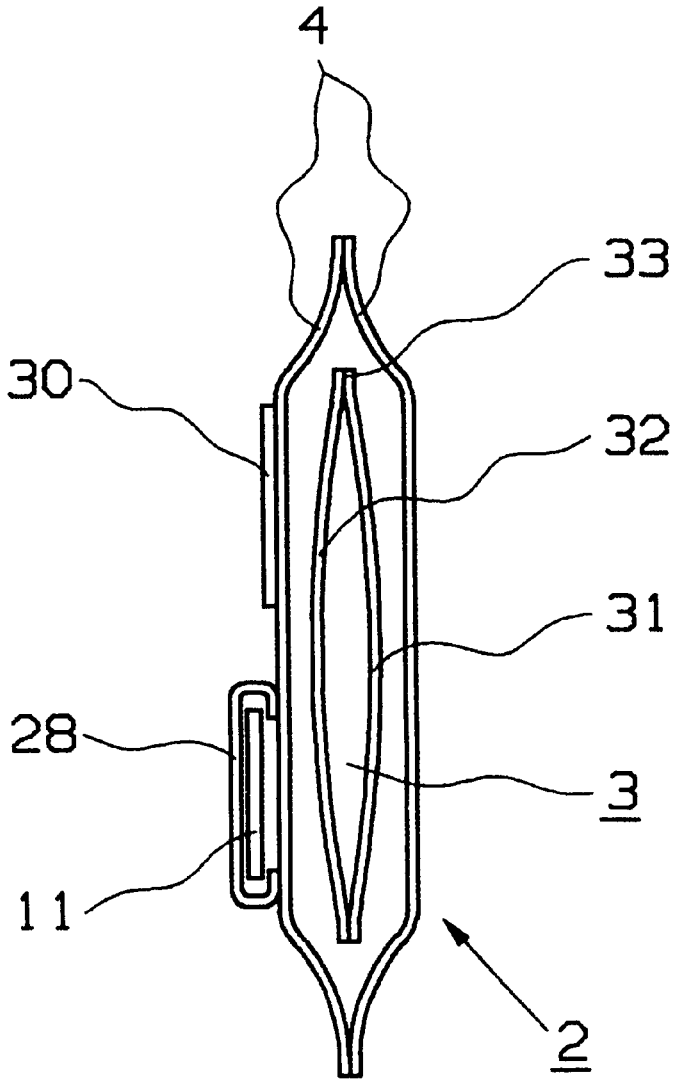
FIG. 4 is a section view taken along line A—A of FIG. 2; and, FIG. 5 is a section view taken along line A—A of FIG. 2 for a single shell support vest.

FIG. 2 shows a view of the support vest 2 as viewed toward the side of the outer enclosure 4 lying on the back of the person carrying the apparatus. The same components are provided with like reference numerals of FIG. 1. The stomach belt 11 is attached to the outer enclosure 4 by means of two loops 28 and has two connecting pieces 29 for making a connection. Corresponding connecting pieces 29 are also provided on the shoulder belts 10. The shoulder belts 10 are sewn directly to the outer enclosure 4 via reinforcement pieces 30. With the placement of the belts (10, 11) as well as the mixed-gas vessel 9 and the carbon dioxide absorber 6 directly on the outer enclosure 4, a direct force transmission of all components having weight to the back of the person carrying the apparatus is achieved while the inner enclosure 3 can freely unfold. The configuration of the inner enclosure 3 is shown in FIG. 4.

Figure 3:
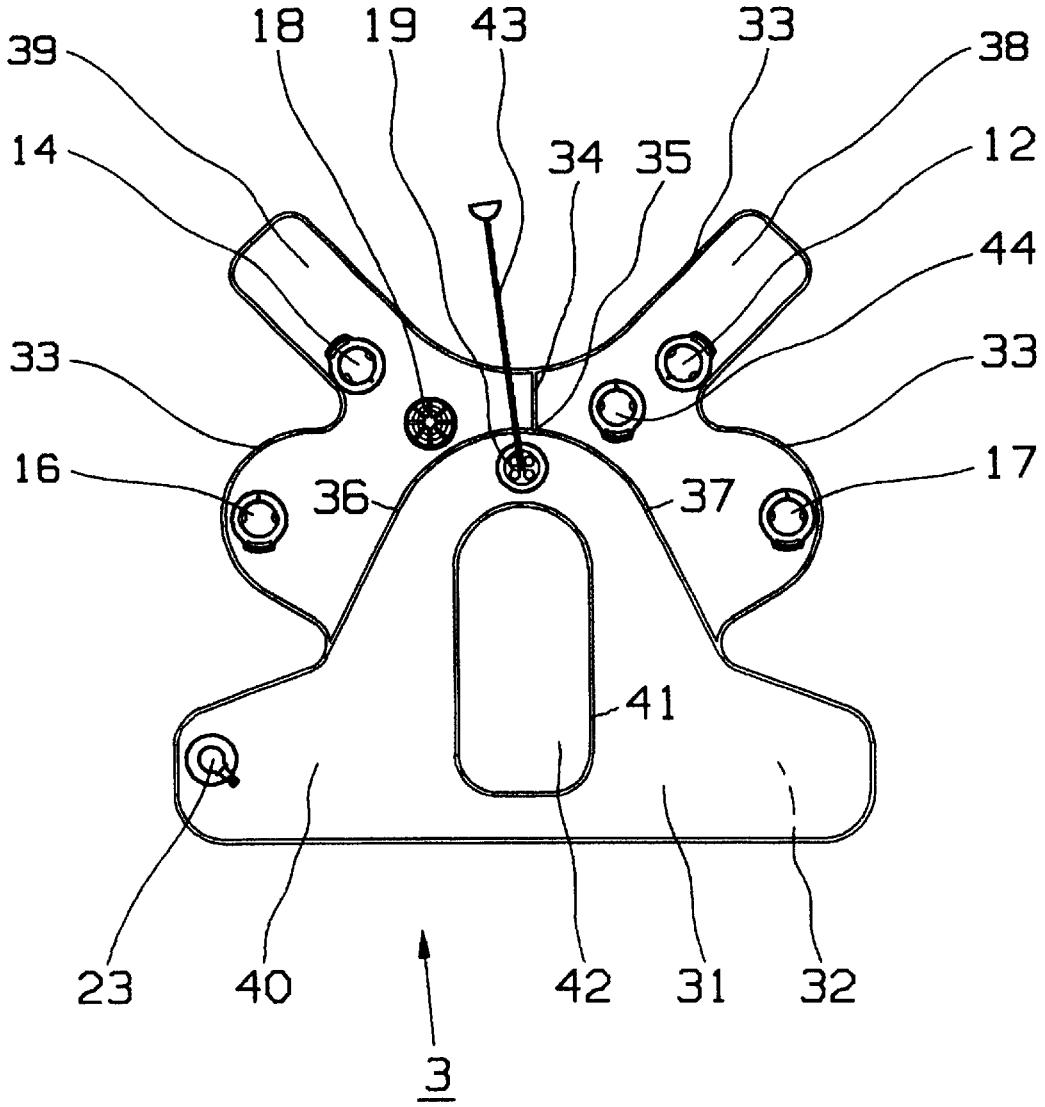
FIG. 3 is a plan view of the inner enclosure of the breathing apparatus of FIG. 1.

FIG. 3 shows a plan view of the inner enclosure 3 in the same viewing direction as in FIG. 1. The same components in FIG. 3 have the same reference numerals as in FIG. 1.

The inner enclosure 3 comprises two panels (31, 32) lying one atop the other and made of nylon-reinforced polyurethane. The two panels are joined to each other at the edges by a first weld seam 33 about the periphery. The panel 32 is not seen in FIG. 3 because it is covered by panel 31. A second weld seam 34 is disposed within the inner enclosure and runs perpendicularly downwardly from the first weld seam 33. Within the inner enclosure, there is also a third weld seam 36 and a fourth weld seam 37. The third weld seam 36 starts from an end point 35 of the second weld seam 34. The weld seams (36, 37) are parabolically curved and are connected at the edge of the inner enclosure 3 to the first weld seam 33.

An inhalation bag 38 is formed by the weld seams (33, 34, 37) from the inner enclosure 3. The weld seams (33, 34, 36) delimit an exhalation bag 39 and the weld seams (33, 36, 37) define a buoyancy bag 40. A fifth weld seam 41 is provided within the buoyancy bag 40 and this weld seam 41 separates an unused volume 42 from the buoyancy bag 40. The buoyancy bag 40 can be filled with gas via the inflation valve 23 and can be emptied via the manually-actuable overpressure valve 19 provided with a pull cord 43. To connect the demand valve 22, a demand valve insert connector 44 is provided within the inhalation bag 38 as shown in FIG. 1.

The breathing gas flow takes place from the inhalation bag 38 via the inhalation tube 13 to the mouthpiece 20 and via the exhalation tube 15 (FIG. 1) into the exhalation bag 39 and then through the carbon dioxide absorber 6 back into the inhalation bag 38. Excess breathing gas can escape via the overpressure valve 18. The second weld seam 34 is the connecting line between the inhalation bag 38 and the exhalation bag 39.

FIG. 4 shows a section view of the support vest 2 along section line A—A of FIG. 2. The panels (31, 32) of the inner enclosure 3 are disposed within the outer enclosure 4. The panels (31, 32) are connected at the edge by the first weld seam 33.

Figure 5:
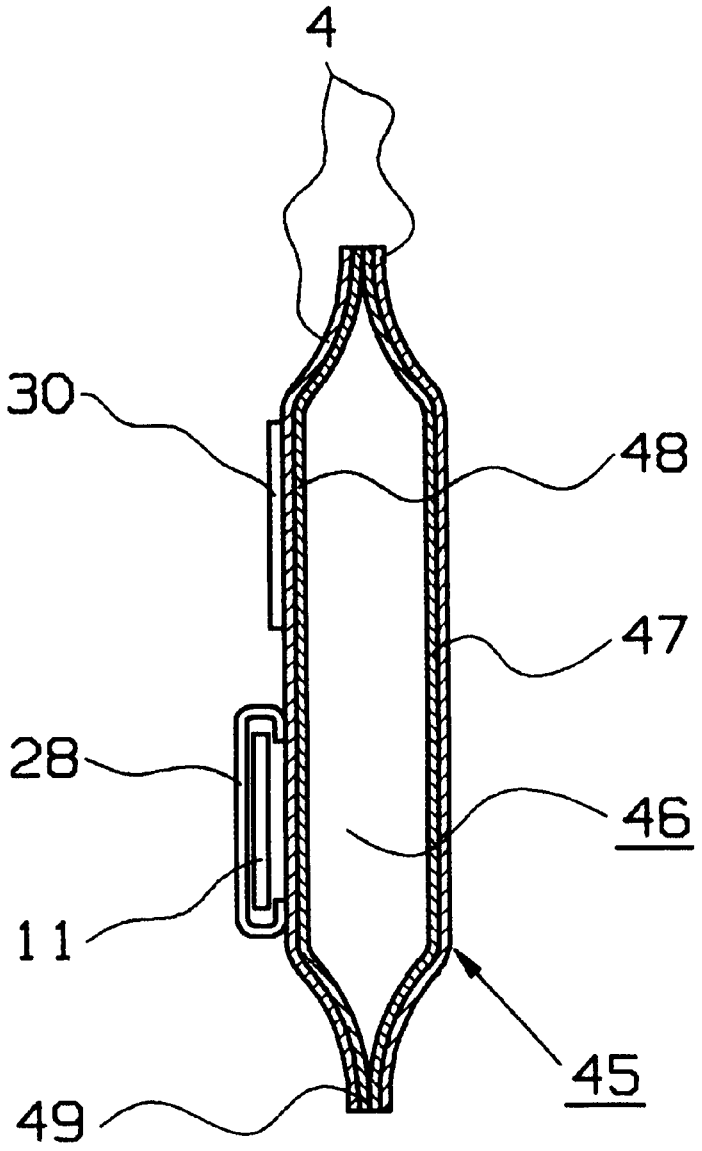

FIG. 5 shows, as an alternate embodiment, the section view along the section line A—A of FIG. 2 of a single-shell support vest 45 wherein two elastomeric panels (47, 48) are connected as a single piece to the outer enclosure 4. The two panels (47, 48) define an inner enclosure 46. The welding of the panels (47, 48) together with the outer enclosure 4 takes place at the outer periphery with the weld seam 49.

Additional weld seams (which are not shown in FIG. 5) are located within the support vest 45 in order to subdivide the same into individual chambers (not shown in FIG. 5), namely: the inhalation bag 38, the exhalation bag 39 and the buoyancy bag 40. Compared to the two-shell embodiment of FIGS. 1 to 4, the single-shell support vest 45 affords the manufacturing advantage in that it can be produced directly by placing textile elastomer-coated panels one atop the other and welding the same. Nylon fabric having a polyurethane coating is especially well suited as a material for the single-shell support vest 45.

It is understood that the foregoing description is that of the preferred embodiments of the invention and that various changes and modifications may be made thereto without departing from the spirit and scope of the invention as defined in the appended claims.

What is claimed is:

1. An underwater breathing apparatus worn on the back of a diver, the apparatus comprising:

a support vest including an inner enclosure and a textile outer enclosure;

said inner enclosure extending from the shoulders to the hips of the diver;

said inner enclosure being formed from two panels made of elastomeric material and lying one atop the other and having a plurality of individual weld seams for subdividing said inner enclosure into an inhalation bag, an exhalation bag and a buoyancy bag;

a mouthpiece;

a first breathing tube connecting said inhalation bag to said mouthpiece;

a second breathing tube connecting said exhalation bag to said mouthpiece;

a carbon dioxide absorber arranged between said inhalation bag and said exhalation bag;

a mixed-gas vessel connected at least to said inhalation bag;

said textile outer enclosure including: a pocket for said mixed-gas vessel; a holder for said carbon dioxide absorber and belts for attaching said outer enclosure to the back of the diver; and, said inner enclosure being configured as an elastomeric inner coating of said outer enclosure.

2. The underwater breathing apparatus of claim 1, wherein said inner enclosure is configured as a component insertable into said outer enclosure.

3. The underwater breathing apparatus of claim 1, wherein said panels conjointly define a periphery and a first one of said weld seams extending along said periphery.

4. The underwater breathing apparatus of claim 3, wherein a second one of said weld seams extends along a connecting line between said inhalation bag and said exhalation bag; a third one and a fourth one of said weld seams extending from said second weld seam to said first weld seam.

5. The underwater breathing apparatus of claim 4, wherein said third weld seam delimits said exhalation bag and said fourth weld seam delimits said inhalation bag.

6. The underwater breathing apparatus of claim 5, said third and fourth weld seams being configured as segments of a circle.

7. The underwater breathing apparatus of claim 5, said third and fourth weld seams being configured to have a polygon-like shape.

8. The underwater breathing apparatus of claim 4, wherein a fifth one of said weld seams is disposed within said buoyancy bag and carves out a volume from said buoyancy bag.

9. An underwater breathing apparatus worn on the back of a diver, the apparatus comprising:

a support vest including an inner enclosure and a textile outer enclosure;

said inner enclosure extending from the shoulders to the hips of the diver;

said inner enclosure being formed from two panels made of elastomeric material and lying one atop the other and having a plurality of individual weld seams for subdividing said inner enclosure into an inhalation bag, an exhalation bag and a buoyancy bag;

a mouthpiece;

a first breathing tube connecting said inhalation bag to said mouthpiece;

a second breathing tube connecting said exhalation bag to said mouthpiece;

a carbon dioxide absorber arranged between said inhalation bag and said exhalation bag;

a mixed-gas vessel connected at least to said inhalation bag;

said textile outer enclosure including: a pocket for said mixed-gas vessel; a holder for said carbon dioxide absorber and belts for attaching said outer enclosure to the back of the diver; and, said inhalation bag and said exhalation bag having respective outwardly directed projections; said projections having lengths which are so dimensioned that they can be folded over in the direction of said carbon dioxide absorber; and, said projections having respective insert connectors for connecting to said carbon dioxide absorber.

10. An underwater breathing apparatus worn on the back of a diver, the apparatus comprising:

a support vest including an inner enclosure and a textile outer enclosure;

said inner enclosure being formed from two panels made of elastomeric material and lying one atop the other and having a plurality of individual weld seams;

said weld seams including:

a first weld seam about the periphery of said inner enclosure;

a second weld seam running perpendicularly downwardly from the top of said first weld seam to an end point;

a third weld seam and a fourth weld seam starting from said end point in a parabolic curved manner and ending at said first weld seam;

an inhalation bag being formed by said first weld seam, second weld seam and fourth weld seam;

said first weld seam, said second weld seam and said third weld seam delimiting an exhalation bag; and, said first weld seam, said third weld seam and said fourth weld seam defining a buoyancy bag.

* * * * *